US006089651A

United States Patent [19]

Carmen

[11] Patent Number: 6,089,651

[45] Date of Patent: Jul. 18, 2000

[54] FOLDING CHAIR ANCHORING SYSTEM

[76] Inventor: Norman Carmen, 4101 Powder Mill Rd., Beltsville, Md. 20705

[21] Appl. No.: 09/354,157

[22] Filed: Jul. 16, 1999

[51] Int. Cl.[7] ..... A47C 4/00

[52] U.S. Cl. ..... 297/16.1; 297/14; 297/56; 297/463.1; 248/501

[58] Field of Search ..... 297/16.1, 14, 15, 297/56, 463.1; 248/501, 240, 240.2

[56] References Cited

U.S. PATENT DOCUMENTS

| | | | |
|---|---|---|---|
| 2,020,230 | 11/1935 | Beisel | 248/501 |
| 2,142,263 | 1/1939 | Bentz | 155/36.5 |
| 2,636,549 | 4/1953 | Gelleer | 155/83 |
| 3,537,748 | 11/1970 | Knapp | 297/16.1 X |
| 3,600,033 | 8/1971 | Holdampf | 297/16.1 |
| 3,873,151 | 3/1975 | Morris et al. | 297/14 |
| 3,881,770 | 5/1975 | Cardenas | 297/51 |
| 4,313,385 | 2/1982 | Fitzgerald | 108/38 |
| 4,652,046 | 3/1987 | Compagnone née Chatenay | 297/15 |
| 5,185,892 | 2/1993 | Mitchell | 297/14 X |
| 5,362,123 | 11/1994 | Simmons | 297/14 |
| 5,375,906 | 12/1994 | Snyder | 297/39 |
| 5,653,502 | 8/1997 | Kimura et al. | 297/217.7 |
| 5,655,459 | 8/1997 | O'Connor et al. | 108/48 |
| 5,718,474 | 2/1998 | Kojima et al. | 297/58 |
| 5,819,670 | 10/1998 | O'Connor et al. | 108/48 |
| 5,848,822 | 12/1998 | Wu | 297/344.18 |
| 5,967,255 | 10/1999 | Young | 297/14 X |

*Primary Examiner*—Peter M. Cuomo
*Assistant Examiner*—Rodney B. White
*Attorney, Agent, or Firm*—Lane, Aitken & McCann, L.L.P.

[57] ABSTRACT

An anchoring device for a conventional folding chair employs a longitudinal rod and two brackets attached to a vertical support member. A retention element on the chair's backrest engages the rod and allows for slidable movement. The rear legs of the chair are pivotally attached to brackets at or near the floor. The arrangement allows the chair to be open and closed and while retained against a wall.

10 Claims, 5 Drawing Sheets

FOLDING CHAIR ANCHORING SYSTEM

The present invention is directed to a restraining system or anchoring system used with conventional folding chairs.

BACKGROUND OF THE INVENTION

In many circumstances it is desirable to provide for seating in a manner in which the chain can be folded up when not in use to minimize its use of space. Although conventional folding chairs are frequently used, because of their portability, folding chairs may be removed from the location where the chair is needed, or stolen. Further, in some locations where the available space is limited, chairs may be moved to locations where they interfere with or impede passage through hallways or corridors. Obviously the presence of a chair within a corridor can present a problem when traffic through the corridor becomes heavy. Further, although it is desirable to provide chairs in public facilities, such as government buildings or other service establishments open to the public, chairs are frequently lost, stolen or damaged. Likewise in public facilities it may be desirable to provide seating under temporary circumstances but retain the ability to maximize the available floor space when seating is not required. The ability to remove or fold-up a chair makes cleaning the floor near and around the chair more convenient.

For example, in hospital rooms and emergency room cubicles, a hospital will typically provide two beds and two chairs. Because adequate room must be provided to allow for a gurney to pass, one should be able to easily move or fold up the chair to enable unimpeded passage through an aisle to the hospital bed. However, because the chairs are not secured, they are frequently moved to other rooms or other locations, and as a result, the chairs must be frequently redistributed by the hospital or visitors are left without a place to sit. Likewise, in public buildings it is desirable to provide chairs for people while they wait.

In another example, in many school gymnasiums, it is desirable to provide chairs along the lateral sidelines of the floor during events. During some periods of time is desirable to remove the chairs to maximize the available floor space on the gym floor or to clean the floor. Simply folding up the chairs is unsatisfactory because in order to keep them upright they must be leaned against the wall and consequently they may extend into the playing area. Simply leaning the chairs against the walls is also unsatisfactory because they are prone to fall down in the event they are disturbed. Moving the chairs to a remote location to store the chairs requires the existence of a suitable location and additional time and effort.

Other examples where it is desirable to be able to provide temporary seating which can be quickly and easily stowed may include mid-sized rooms, multipurpose rooms such as those used for meetings or instructional purposes such as rooms used for CPR training or health classes, exercise, self-defense, and dancing. In these circumstances, during the instructional portion of a meeting the participants sit and later rise to participate in the event. During a portion of the event it may be desirable to maximize the available floor space.

There is need for a simple and inexpensive folding chair which can be secured to a location. Accordingly it is an object of the present invention to provide a manner in which to anchor a conventional folding chair in a manner which allows for the chair to be folded and left upright or be used in the open position. It is a further object of the invention to provide an anchoring system which allows for the chair to be adjusted from a folded position to the extended seating position with a single hand.

SUMMARY OF THE INVENTION

The present invention is an anchoring system designed to be used with conventional folding chairs having front legs which extend past a seat rearwardly, rear legs and a backrest. The rear legs are restrained at a location at or near the floor to allow for limited pivotal movement and the back rest is attached to a vertical member which allows for vertical movement. The system involves providing a rod or rods through openings provided on the rearwardly extending legs at a location near the floor to allow the rear legs to pivot. At the top of the back support of the chair a second rod is provided which allows for vertical movement. The anchoring system is designed to be used with a conventional folding chair.

DETAILED DESCRIPTION

Figure 1:
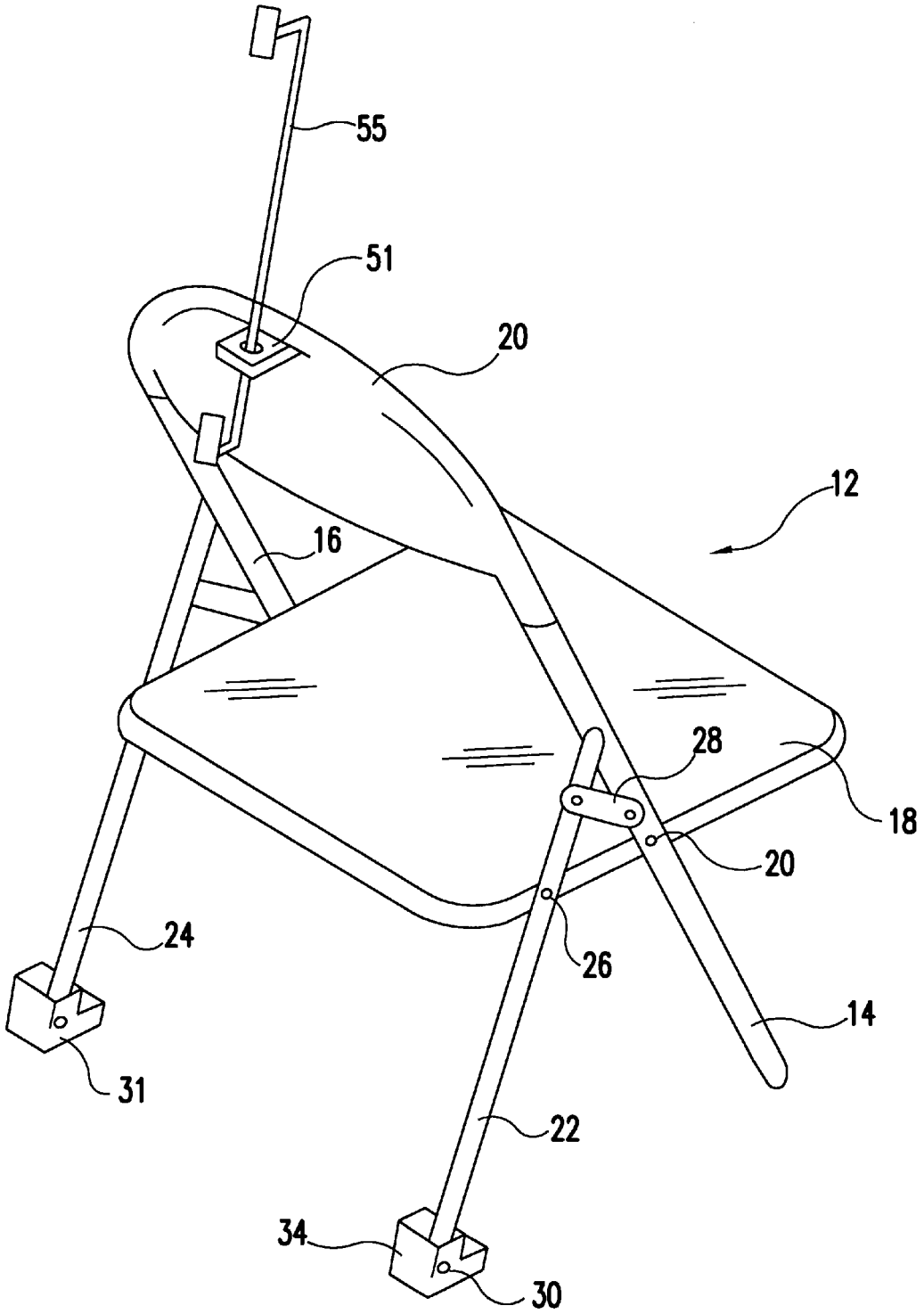
FIG. 1 is a perspective view of the anchoring system for a folding chair according to a first embodiment of the invention.
Figure 2:
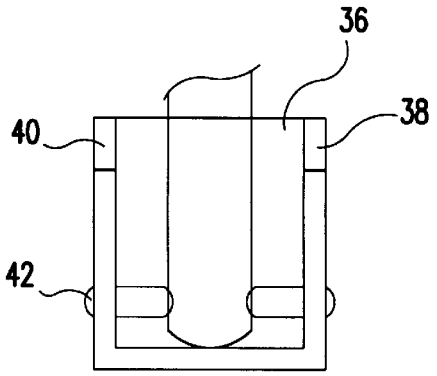
FIG. 2 is a front plan view of a leg bracket in engagement with a rear leg according to a first embodiment of the invention.

Now referring to FIG. 1, a folding chair generally designated by the numeral 12 has a front legs 14 and 16 which extend from the floor to lateral sides of seat 18. The legs extend upwardly and rearwardly where they connect with back rest 20. Seat 18 is attached to the front leg 14 at a first location 20 which allows for pivotal movement of the leg. Rear legs 22 and 24 extend from the floor, are attached to the seat, and terminate adjacently to the front legs. Seat 18 is also attached to the rear leg 22 in a manner which allows the leg to pivot around location 26 so the chair can be folded. Stabilizer bar 28 restricts the movement with respect to the front and rear legs and provides additional support and rigidity to the chair. L shaped bracket 30 and 31 are provided at the ends of the rear legs 22 and 24 respectively. Surface 34 on the rear of bracket 30 can be attached to a vertically oriented structural member such as a wall. As best seen in FIG. 2, bracket 30 has two sidewalls 38 and 40 and an end wall 36 which define a trough having a "U shaped" profile. A horizontally displaced axial rod 42 intersects the sidewalls 40 and 38 and passes through leg 22 through a radial opening provided therein. The trough may be attached to either the vertical member 50 or the floor with conventional fasteners such as screws, bolts, an adhesive. This arrangement allows for the retention of the rear legs and provides for pivotal motion about an axis defined by rod 42. The rod may be positioned to support the weight of the chair when it is in a folded and upright position however when the chair is in the open position the spacial relationship between the rod 42 and the legs is preferable arranged so that the weight of the chair is substantially borne by the legs including leg 22.

Figure 4:
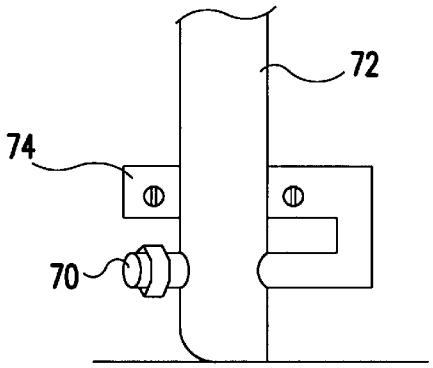
FIG. 4 is a front view of an alternative embodiment of a leg restraint.
Figure 3:
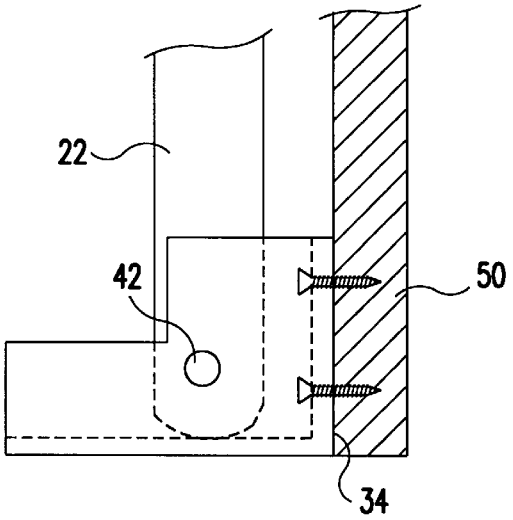
FIG. 3 is a side plan view of the leg bracket according to a the first embodiment of the invention.
Figure 5:
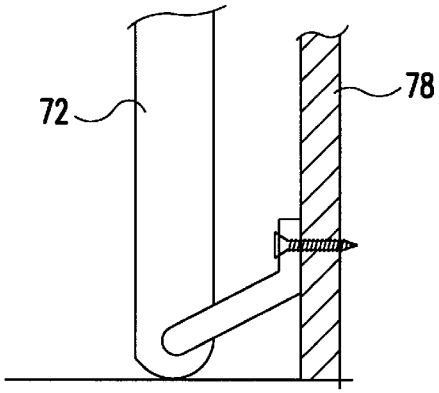
FIG. 5 is a side view of the embodiment of the leg restraint as depicted in FIG. 4.

FIGS. 4 and 5 depict an alternative embodiment of a rear leg restraint which also employs a pin portion 70 which radially transverses the rear leg 72 at a location near the floor. The opposite portion 74 of the "U" shaped part is secured to a structural member. It is further contemplated that other embodiments which allow for pivotal motion may also be employed to restrain the rear legs such as a hinges.

Figure 13:
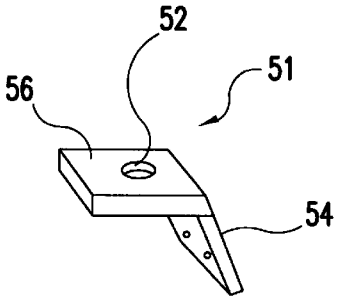
FIG. 13 is a perspective view of the back rest restraint according to the embodiment depicted in FIG. 1.
Figure 14:
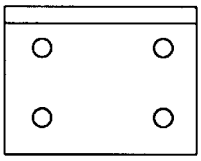
FIG. 14 is a front view in elevation of the back rest restraining element shown in FIG. 13.

Now referring back to FIG. 1, a second bracket 51 extends from the rear side of back rest 20 which has a first portion 54 which engages the rear of the back rest and a second region 56 which extends in a horizontal direction, substantially parallel with the floor. As best seen in FIGS. 13 and 14 annular opening 52 is provided through the second section 56 which receives the vertically oriented retaining rod 55. The opposite ends of retaining rod 55 are and attached to a vertically oriented structural member by conventional fasteners.

Figure 6:
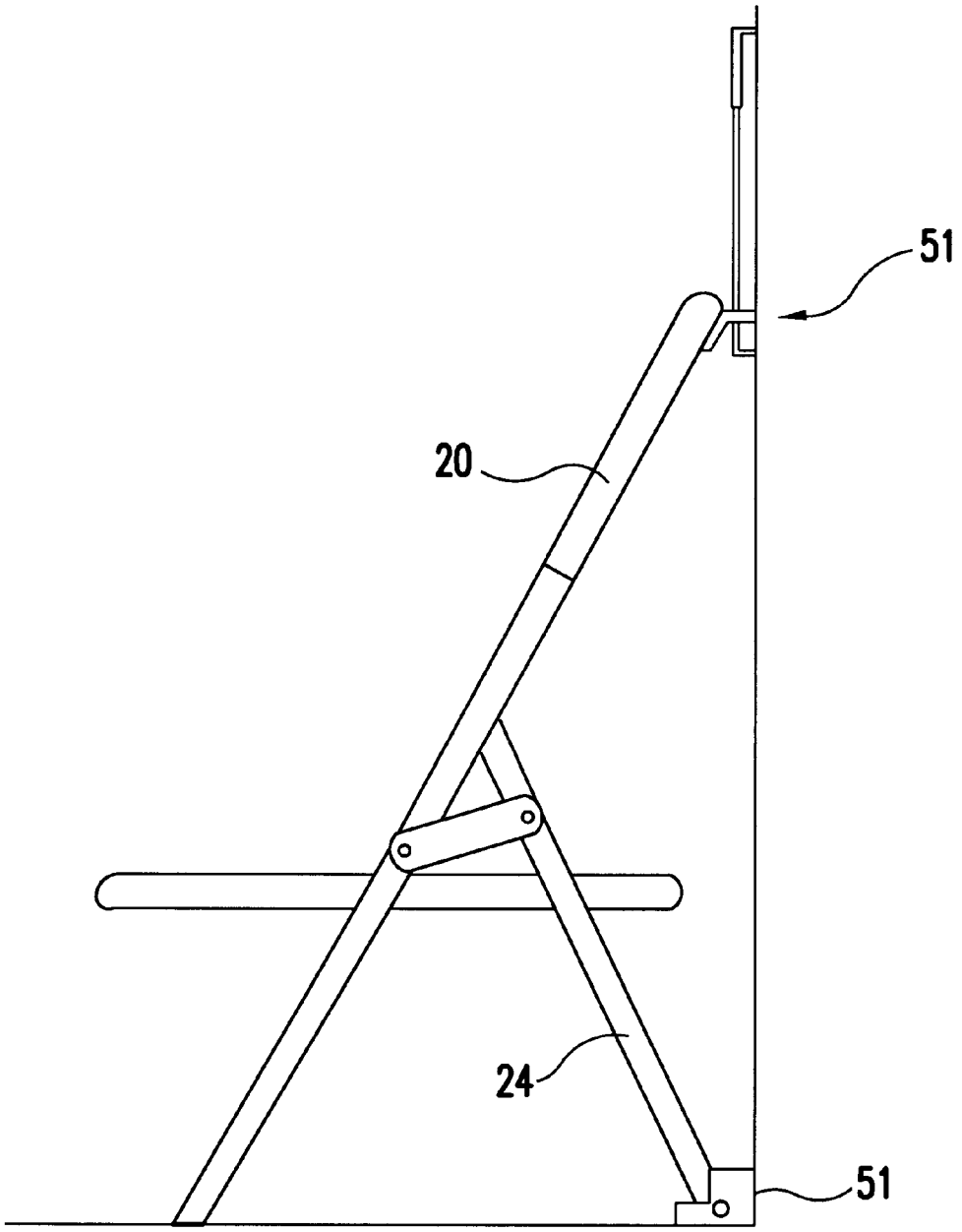
FIG. 6 is a side view in elevation of a conventional folding chair in the open position in engagement with the system according to the first embodiment of the invention.
Figure 7:
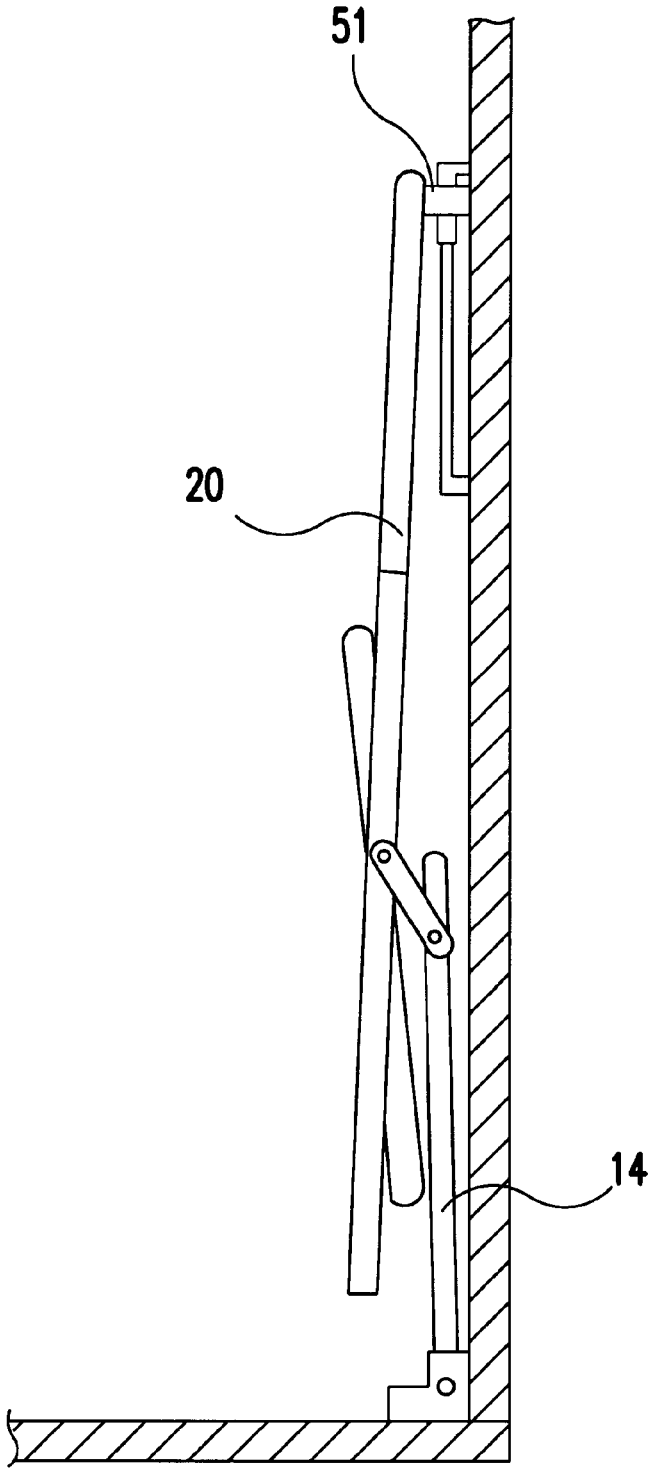
FIG. 7 is a side view in elevation of the assembly shown in FIG. 6 with the chair in the folded position.

FIG. 6 depicts the chair in an open position with the rear legs restrained by the leg restraining bracket 31 and back rest restrained by retraining bracket 51. Bracket 51 restricts movement of the back rest except in the vertical direction. When the chair is in the open position, the bracket 51 is engages the rod near the bottom. Now referring to FIG. 7, chair 12 is shown in a closed position. In the closed position rear leg 24 and back rest 20 are substantially parallel with and adjacent to the upright structural member 50. As shown bracket 51 has slid up from the bottom position depicted in FIG. 6 to a position near the top of the rod is attached to the wall. The chair is retained in a closed position and against the wall by frictional forces between the bracket and vertical retaining rod as well as frictional forces which are present between the moveable components of conventional folding chairs. The length of the rod 55 is selected to allow the chair to be moved from an open position to a fully closed or folded position without interference with the ends portions of the rod which are directed toward the upright structural member.

Although in the preferred embodiment the rear legs are by a pin and "U shaped" restraining element, a single "U" shape pin or shackle such as that depicted in FIG. 13 could be employed to restrain the bottom of the folding chair which allows for pivotal movement.

Figure 8:
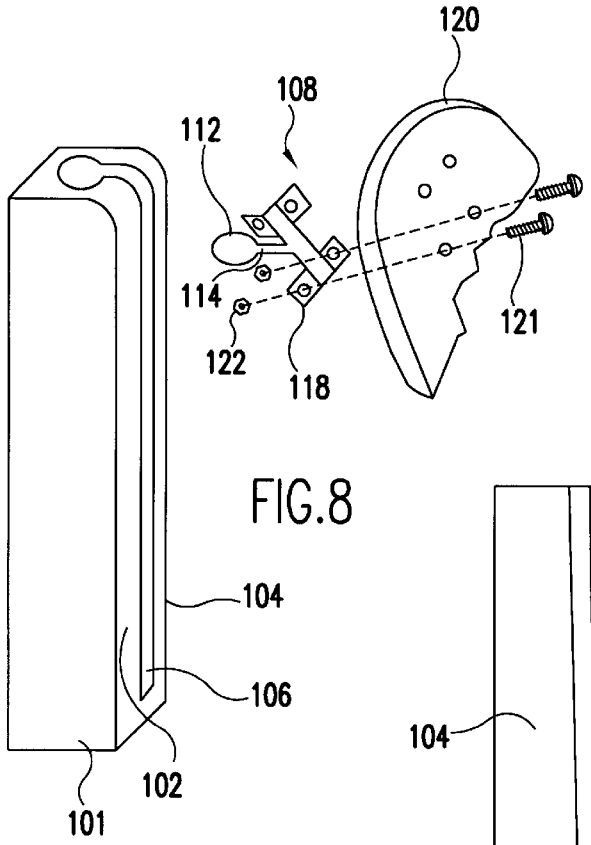
FIG. 8 is a perspective fragmentary exploded view of a back restraining assembly according to an alternative embodiment of the invention.
Figure 9:
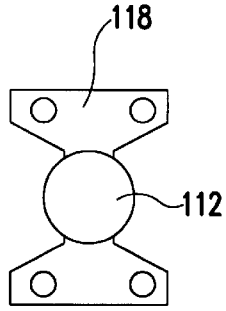
FIG. 9 is a front view in elevation of the back rest restraining element according to the embodiment of the invention depicted in FIG. 8.
Figure 10:
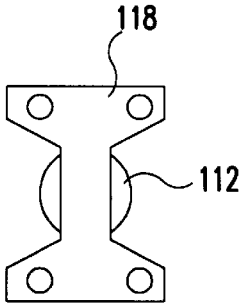
FIG. 10 is a rear view in elevation of the device depicted in FIG. 9.
Figure 11:
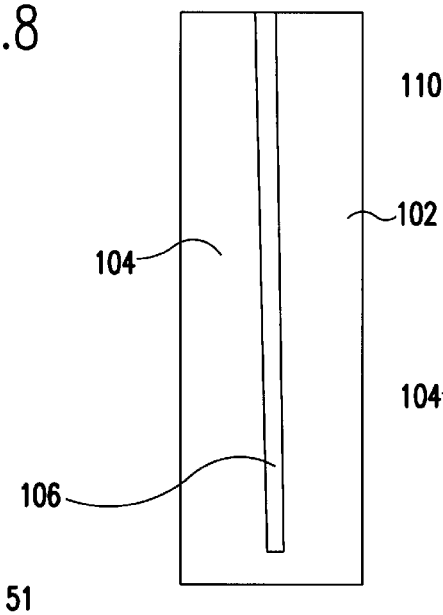
FIG. 11 is a front view in elevation of the track element depicted in FIG. 8.

FIG. 8 depicts another embodiment of the invention wherein a vertical oriented track is provided to retain and guide the back rest of a char. In this embodiment track 101 is provided with parallel front walls 102 and 104 which define a vertically oriented elongate slot 106. Back rest retainer 108 has a spherical element 112 extending from a rod 114 which is attached to a bracket 118. Bracket 118 is attached to a backrest 120 of a chair by nuts 122 and bolts 121. At the top of the track 101 the slot 106 expands to forma an enlarged opening 124 to allow the track to receive the spherical element 112. When assembled, the ball is restrained behind the front walls of the track and the rod 114 extends through slot 106. This arrangement allows the retainer 108 to freely move up and down within the track and retains the back rest against an upright structural member.

Figure 12:
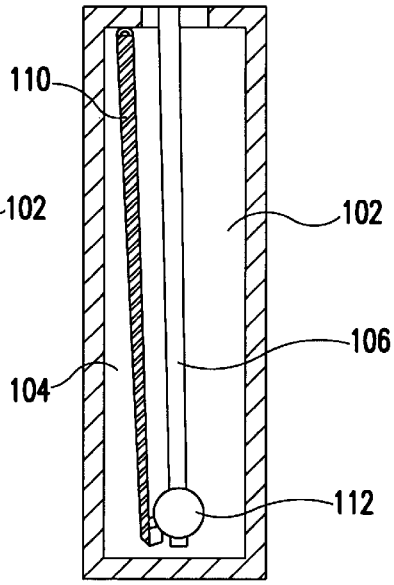
FIG. 12 is a rear sectional view of the track element depicted in FIG. 11 showing the engagement of the terminal end of the back rest restraining element.

A further contemplated feature of the invention is depicted in FIG. 12 showing a spring 110 used to bias the chair in the folded position. In the contemplated embodiment one end of spring 110 is attached to the top of the vertical oriented track 102 and the opposite end is attached to the back rest retainer 108. FIG. 12 depicts the spring in the stretched or extended position when the chair is in an open position. Force imposed upon the seat of the chair, such as that imposed by the weight of an individual, overcomes the force applied by the spring, stretches the spring and allows the seat to be configured to the open position. When the force is removed from the seat, the spring biases the chair back to the closed and folded position by pulling retainer 108 to the top of the track. In a further contemplated embodiment a spring may be provided between the front and rear legs applying a biasing force causing the front and rear legs to be drawn together. Sufficient pressure applied to the seat will overcome the biasing force and allow the chair to open.

Figure 15:
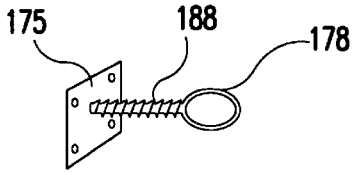
FIG. 15 is an alternative embodiment of a back rest restraining element.
Figure 16:
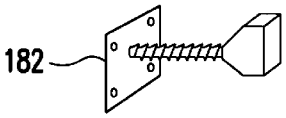
FIG. 16 is another alternative embodiment of a back rest restraining element.

FIG. 15 depicts an alternative embodiment of the back restraining element which can be used with either the rod 55 or the track element 101. Bracket 175 is attached to the back rest of the chain and connecter to an annular ring 178 by chain 180. The annular ring may be either used with rod 55 or inserted behind the slot 106 within track 101 to provide for a slidable engagement. FIG. 16 provides for yet another alternative back restraining element which can be used with track 101 and consists of a bracket 182 for attachment to the back rest, a chain 184 which is received within the slot 106 and an enlarged end piece 186 which fits behind slot 106.

In further contemplated embodiments the upright member may simply be a post or a pair of posts with two corresponding back retainers provided on opposite sides of the back rest. The track embodiment affords the opportunity to attach the chair to a single, horizontally oriented, structural member such as a fence rail. Accordingly the chairs can easily be adopted for use within conventional box seats such found at stadiums and grandstands. Providing the chairs in this environment allow the chairs provided within the box to be easily folded to make room for individuals with disabilities and confined to wheelchairs or motorized seats. In this arrangement the rear legs of the chair can simply be attached to the floor rather than the wall.

The forgoing invention can be used with conventional folding chairs and can be adapted for a wide variety of applications. For example, in addition to uses cited above, the chair and anchoring system as described may be e designed for use in automobiles or trucks resulting in a highly versatile vehicle. A further advantage of the system as disclosed is that it allows for the opening and closing of the chair with a single hand.

Although a number of specific embodiments have been described and illustrated herein, those having skill in the art will appreciate that there are additional arrangements and applications employing the invention which may be substituted for the specific disclosure as described herein. Having thus described the present invention and its preferred embodiment in detail, it will be readily apparent to those skilled in the art that further modifications to the invention may be made without departing from the spirit and scope of the invention as presently claimed.

I claim:

1. A combination of a folding chair and anchoring system for securing said chair to an upright structural member comprising a folding chair, a leg restraining element and a back rest restraining assembly, said folding chair further comprising rear legs, front legs, a seat, and a backrest, wherein said rear legs extend substantially the same distance from said seat to a floor as said front legs, said leg restraining element further comprising a transverse member to radially intersect said rear legs and provide for pivotal movement of said rear legs and means to attach said transverse member to a structural member, and said back rest restraining assembly further comprising a vertically oriented elongate member, said vertically oriented elongate member having means for attachment to said upright structural member and a back rest retention element extending from said backrest and engaging said vertically oriented elongate member in a manner providing for slidable movement along the length of said vertically oriented elongate member.

2. A system for anchoring a folding chair to an upright structural member, comprising a leg restraining element and a back rest restraining assembly, said leg restraining element comprising an axle radially intersecting a rear leg of said folding chair to allow for pivotal movement of said rear leg and means to attach said restraining element to said upright structural member, and said back rest restraining assembly comprising a vertically oriented elongate member and a back rest retention member, said back rest retention member extending from a back rest of said chair, and said vertically oriented elongate member having means for attachment to said upright structural member, and means to engage said back rest retention member in a manner which allows for slidable movement in a vertical direction, and said system is adapted to be used with folding chairs comprising a seat, front legs extending from said seat in a downward and forward direction and rear legs, said rear legs supporting said seat from a floor and extending from said seat a distance substantially equal to the distance said front legs extend from said seat, and said rear legs extending in a downward and rearward direction from said seat, and a backrest.

3. The combination as recited in claim 1 wherein said leg restraining element further comprises a "U" shaped trough, having a floor and opposite side walls, and said axle member comprising a pin which radially transverses said rear legs and said opposite side walls.

4. The combination as recited in claim 1 further comprising biasing means to bias said folding chair in a folded position.

5. The combination as recited in claim 4 wherein said biasing means further comprises a coiled spring having one end attached to said back rest and the other end attached to a fixed position with respect to said upright elongae member.

6. The combination as recited in claim 1 wherein said back rest restraining assembly further comprises a rod and said back rest retention element comprises a part to engage said rod to allow for movement along the length of said rod.

7. The combination as recited in claim 6 wherein said back rest retention element comprises an annular opening.

8. The combination recited in claim 6 wherein said annular opening further comprises a circular opening.

9. The combination as recited in claim 1 wherein said vertically oriented elongate member comprises a slot and said back rest retention member further comprises an extension having an enlarged distal end which is received and retained in said slot in a slidable engagement.

10. The combination as recited in claim 1 wherein said upright member is a wall or a post.

* * * * *